US007735755B2

(12) United States Patent
Near

(10) Patent No.: US 7,735,755 B2
(45) Date of Patent: Jun. 15, 2010

(54) NOZZLE ASSEMBLY, DELIVERY SYSTEM AND METHOD FOR CONVEYING INSULATION MATERIAL

(75) Inventor: Daniel Elden Near, Littleton, CO (US)

(73) Assignee: Johns Manville, Denver, CO (US)

( * ) Notice: Subject to any disclaimer, the term of this patent is extended or adjusted under 35 U.S.C. 154(b) by 439 days.

(21) Appl. No.: 11/784,261

(22) Filed: Apr. 6, 2007

(65) Prior Publication Data

US 2008/0245885 A1 Oct. 9, 2008

(51) Int. Cl.
*B05B 7/06* (2006.01)
*B05B 17/04* (2006.01)

(52) U.S. Cl. ..... 239/425; 239/11; 239/419; 222/567; 222/630; 156/78; 264/121

(58) Field of Classification Search ..... 239/11, 239/419, 425; 222/567, 630; 156/78; 264/121
See application file for complete search history.

(56) References Cited

U.S. PATENT DOCUMENTS 4,168,959 A * 9/1979 Loeffler ..... 65/450
4,487,365 A 12/1984 Sperber
4,530,468 A 7/1985 Sperber
4,648,920 A 3/1987 Sperber
4,768,710 A * 9/1988 Sperber ..... 239/8
4,923,121 A * 5/1990 Boyer ..... 239/434.5
D309,309 S 7/1990 Sundheim et al.
5,403,128 A * 4/1995 Thomas ..... 406/39
5,795,517 A * 8/1998 Heisler et al. ..... 264/115
6,045,298 A * 4/2000 Lytle ..... 406/48
6,047,518 A 4/2000 Lytle
6,325,605 B1 * 12/2001 Clements et al. ..... 425/83.1
7,341,631 B2 * 3/2008 Fellinger ..... 118/308
2007/0234649 A1 * 10/2007 Near et al. ..... 52/73
2008/0217422 A1 * 9/2008 Near ..... 239/8

* cited by examiner

*Primary Examiner*—Len Tran
*Assistant Examiner*—James S Hogan
(74) *Attorney, Agent, or Firm*—Robert D. Touslee

(57) ABSTRACT

A nozzle assembly for conveying a flow of particles of insulation material suspended in air to a substrate to form an insulation product on the substrate is provided, including: a nozzle body defining a flow path for accommodating the flow of particles of insulation material suspended in air, wherein the nozzle body comprises an inlet for receiving the flow of particles of insulation material suspended in air; an outlet for propelling the flow from the nozzle assembly; and at least one expansion section in which the cross-sectional area of the nozzle body expands in the direction of flow, the at least one expansion section being effective to reduce the velocity of the particles flowing therethrough; and at least one binder outlet for providing a binder to the flow of particles of insulation material propelled from the outlet.

21 Claims, 1 Drawing Sheet

NOZZLE ASSEMBLY, DELIVERY SYSTEM AND METHOD FOR CONVEYING INSULATION MATERIAL

BACKGROUND

Loose fill fibrous insulation can be blown or pumped into attics, walls and other surfaces of houses and other buildings. The loose fill fibrous insulation can include inorganic material such as fiberglass and/or organic material such as cellulose fibers. A binder can be added to the fibrous insulation as it is emitted from a nozzle to bind the insulation particles together.

In conventional methods and systems, the fibrous insulation is blown into a cavity defined between two adjacent elongated supporting members such as studs or purlins by directing a flow of the fibrous insulation into the cavity. In such conventional methods and systems, it is necessary to adjust the insulation flow both in a direction perpendicular to the elongated supporting members as well as in a direction parallel to the elongated supporting members in order to adequately fill the cavity with the insulation material.

This conventional technique and system of filling the cavity presents several drawbacks. For example, when the insulation flow is directed back and forth in a direction perpendicular to the elongated supporting members, the flow typically impacts the supporting members, causing build-up of the insulation material on the supporting members and/or fly off of the insulation material from the supporting members. Such build-up can adversely affect the user's ability to determine the endpoint of the filling of the cavity, and as such, overfilling of the cavity can occur. In addition, the fly off of the insulation material can result in wasted materials, and in particular the use of excess binder. Further, the conventional techniques and systems that require both parallel and perpendicular directional adjustments of the insulation flow can be prone to a relatively high degree of user error and/or fatigue during the installation process, since it is necessary for the user to make frequent nozzle position adjustments.

In addition, conventional techniques and systems generally do not provide adequate means for controlling the density of the blown-in insulation. The installation of blown-in insulation having a density that is higher than what is required for a specific application can result in the use of excess insulation and binder material, which can in turn contribute to increased installation costs.

Furthermore, because specific parameters of the blowing process such as temperature, humidity, the particle size and consistency of the loose fill fibrous insulation, the blowing machine settings, etc. can vary from site to site, it can be difficult in conventional techniques and systems to attain a desirable flow pattern emitted from the blowing nozzle, and to obtain a desired density of the blown-in insulation product.

SUMMARY

According to one aspect, a nozzle assembly for conveying a flow of particles of insulation material suspended in air to a substrate to form an insulation product on the substrate is provided, comprising: a nozzle body defining a flow, path for accommodating the flow of particles of insulation material suspended in air, wherein the nozzle body comprises an inlet for receiving the flow of particles of insulation material suspended in air; an outlet for propelling the flow from the nozzle assembly; and at least one expansion section in which the cross-sectional area of the nozzle body expands in the direction of flow, the at least one expansion section being effective to reduce the velocity of the particles flowing therethrough; and at least one binder outlet for providing a binder to the flow of particles of insulation material propelled from the outlet.

According to another aspect, a method of forming a blown-in insulation product is provided, comprising directing a flow of particles of insulation material suspended in air emitted from a nozzle assembly at a substrate, wherein the nozzle assembly is structured such that the flow emitted therefrom forms an insulation product on the substrate having a thermal resistivity of from about R-3.3 to R-4.0 per inch, wherein the flow emitted from the nozzle assembly is effective to minimize the density of the blown-in insulation product while maintaining the thermal resistivity of from about R-3.3 to R-4.0 per inch.

DETAILED DESCRIPTION

Figure 1:
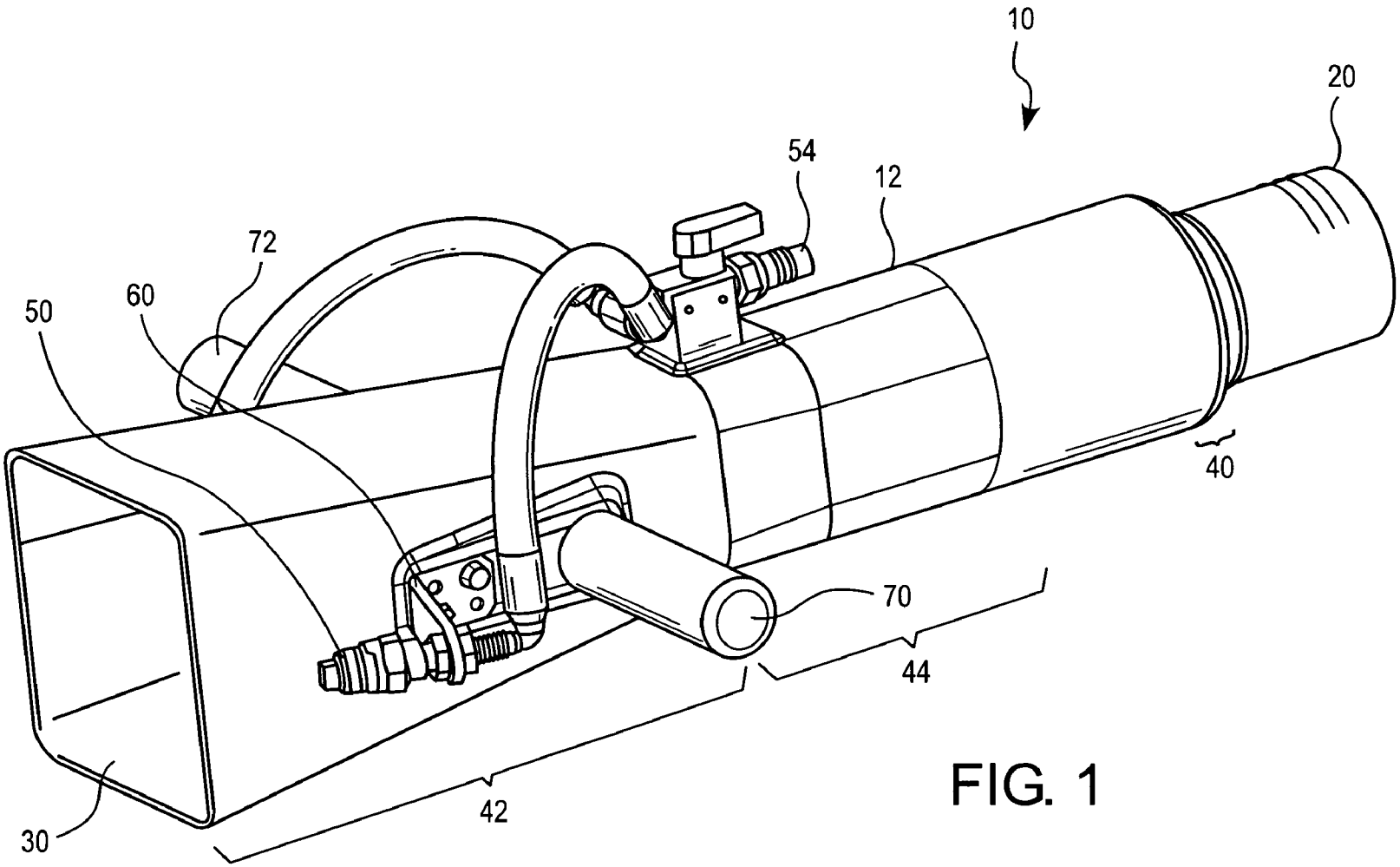
FIG. 1 is a perspective view of an exemplary nozzle assembly according to one aspect.

Referring to FIG. 1, a nozzle assembly 10 is provided for accommodating a flow of insulation particles suspended in air. The nozzle assembly 10 can include a nozzle body 12 having an inlet 20 for receiving a flow of insulation particles suspended in air and an outlet 30 for propelling the flow from the nozzle assembly 10. The nozzle body 12 defines a flow path through which the flow of insulation particles suspended in air passes. The nozzle body 12 can be formed from any suitable material for accommodating the flow of insulation particles suspended in air, and can be formed from, for example, a moldable plastic material. In one embodiment, the material forming the nozzle body 12 can be a rigid yet flexible material.

The inlet 20 can be connected to receive the flow of insulation particles suspended in air from a conduit such as a flexible blow hose, which can in turn be in communication with a source of insulation particles such as a blowing machine. The flow can pass through the flow path of the nozzle body 12 and be propelled from the outlet 30 of the nozzle assembly 10 at a substrate on which the insulation is to be formed.

The substrate can include any conventional surface on which insulation can be formed such as, for example, oriented strand board ("OSB"), plywood, hardboard, natural lumber, metal studs, metal decking, poured concrete, prefabricated concrete, spray-applied or rigid foam insulation, foam or fiberboard vent chutes, plastic vent chutes, and other products known in the construction art that are installed as a part of a building prior to the installation of insulation materials. For example, a wall, floor or ceiling cavity can constitute the space defined between two adjacent elongated supporting members such as, for example, studs or purlins. A backing surface arranged between the elongated supporting members can constitute the substrate on which the insulation material is formed. The elongated supporting members can be arranged substantially parallel to each another, and can be spaced any distance apart, for example, in accordance with the structural requirements of the facility to be insulated. For example, the distance between adjacent elongated supporting members can be about 16 inches on center or about 24 inches on center, which are standard distances employed in the industry.

The nozzle assembly 10 can have any overall dimensional and weight specifications that are suitable for use with an insulation blowing system, and in one embodiment the nozzle assembly 10 can be sufficiently compact and lightweight to facilitate use by hand. For example, the nozzle assembly 10 can have an overall length of from about 12 inches to about 32 inches, and in another embodiment from about 18 inches to about 28 inches. For example, in an alternative embodiment, the nozzle assembly can have an overall length of about 26 inches.

The inlet 20 of the nozzle assembly 10 can have any diameter that is suitable for receiving the flow of insulation particles from a conduit conveying such flow such as a flexible blowing hose. For example, the inlet 20 can have a diameter that is substantially the same as the diameter of the conduit which provides such flow. For example, the inlet 20 can have a diameter of from about 2 inches to about 4 inches, and in another embodiment about 3 inches.

The nozzle body 12 can have any shape suitable for accommodating a flow of insulation particles suspended in air. In an exemplary embodiment, the nozzle body 12 includes at least one expansion section in which the cross-sectional area of the nozzle body 12 expands in the direction of flow. The at least one expansion section is effective to reduce the velocity of the particles flowing therethrough. For example, in an exemplary embodiment, the nozzle body 12 can have a shape that is effective to reduce the velocity of the particles flowing through the nozzle body 12 by at least about 50%, and in alternative embodiments, from about 60% to 90%, or from about 70% to about 80%, of the velocity of the particles introduced to the inlet 20.

Advantageously, by decreasing the velocity of the particles propelled from the outlet 30 and delivered to the substrate, an insulation product can be formed having a reduced density. As discussed above, one problem that can exist in blown-in insulation systems is the use of excess insulation material which exhibits a higher thermal resistivity (R-value) rating than is necessary. By employing the nozzle assembly 10 according to an exemplary aspect, the use of excess material can be reduced or eliminated in applications which only require an insulation product having a relatively lower thermal resistivity such as, for example, about R-3.7 per inch.

As discussed above, the nozzle body 12 can include at least one expansion section arranged downstream from the inlet 20 which is effective to reduce the velocity of the particles flowing through the nozzle body 12. The amount of velocity reduction can be based on, for example, the desired density and thermal resistivity of the insulation product to be formed. For example, as the flow enters into the expansion section, the velocity of the insulation particles is decreased as a result of flowing into a larger volume. In an exemplary embodiment, the nozzle body 12 can have a first expansion section 40 located adjacent to or contiguous with the inlet 20, and a second expansion section 42 located adjacent to or contiguous with the outlet 30: The length of the at least one expansion section (or in the case of multiple expansion sections, the sum of the lengths of the sections) can constitute any suitable proportion of the overall length of the nozzle assembly 10, for example, at least about 30%, or from about 50% to 90%, of the overall length of the nozzle assembly 10.

The manner in which the at least one expansion section is structured is not particularly limited so long as, for example, the expansion section provides the desired velocity reduction. In an exemplary embodiment, the flow can undergo a substantially abrupt expansion through the first expansion section 40, and the flow can undergo a substantially gradual expansion through the second expansion section 42. For example, the first expansion section can expand from an approximately 3-inch cross-sectional diameter to an approximately 4-inch cross-sectional diameter over a relatively short length such as, for example, less than about 1 inch. In an exemplary embodiment, the cross-sectional area of the flow path at an outlet of the second expansion section 42 is greater than the cross-sectional area of the flow path at an inlet of the second expansion section 40, and the cross-sectional area of the flow path does not decrease from the inlet of the second expansion section 42 to the outlet of the second expansion section 42. That is, in this exemplary embodiment, the cross-sectional area of the flow path through the second expansion section 42 is not reduced at any point therein in the direction of the flow through the nozzle assembly 10. For example, the cross-sectional area of the flow path through the expansion section 42 can constantly increase in the direction of the outlet 30. In an exemplary embodiment, the second expansion section 42 can be contiguous with the outlet 30 of the nozzle assembly 10.

Optionally, the nozzle body 12 can include a flow pattern-shaping section 44 for shaping the flow pattern provided from the inlet 20 to more closely resemble the shape of the outlet 30. For example, in an embodiment where the inlet 20 is substantially circle-shaped and the outlet 30 is substantially rectangular- or square-shaped, the flow pattern-shaping section 44 can have a cross-sectional profile of an intermediate shape that assists in conforming the flow pattern provided from the inlet 20 into the shape of the outlet 30. For example, one or more sections having a polygon-shaped cross-sectional profile having more than 4 sides can be employed in the flow pattern shaping section 44, such as a polygon having at least 8 sides. Conforming the shape of the flow to more closely resemble the rectangular or square-shaped outlet 30 can, for example, facilitate the filling of rectangular or square-shaped cavities.

The outlet 30 of the nozzle assembly 10 can have a shape that is suitable for propelling the flow of insulation particles suspended in air to the substrate. In an exemplary embodiment, the outlet 30 can have a shape that facilitates the delivery of the insulation particles flowing at a reduced velocity from the nozzle body 12. For example, the outlet 30 can have a substantially circular shape, elliptical shape, rectangular shape or square shape, but is not necessarily limited to any of such shapes. In an exemplary embodiment, the shape of the outlet 30 can have at least two axes of symmetry, wherein the intersection of the axes can substantially correspond to the center of the inlet 20. In an exemplary embodiment, the outlet 30 can have a substantially rectangular-shaped profile, for example, a substantially square-shaped profile. A square-shaped profile can be especially suitable in applications which involve the filling of wall, floor or ceiling cavities, as the flow emanating from such outlet 30 can facilitate the even filling of the cavities. In the case where a substantially rectangular or substantially square shape is employed, the corners of such profile can be rounded.

The outlet 30 can have any dimensions suitable for accommodating the flow of particles flowing at a reduced velocity. The dimensions of the outlet 30 can depend on, for example, the dimensions of the substrate to be insulated and/or the size of the insulation particles intended to be used. If the outlet 30 is excessively narrow, it can impede the particle flow therethrough, and an excessively large outlet 30 can have an adverse effect on the flow pattern and/or density characteristics. For example, in the case where the outlet 30 has a substantially square shape, the sides of the outlet 30 can be from about 4 to 6 inches, for example, about 5 inches. In the case where the outlet 30 has a substantially circular shape, the diameter of the outlet 30 can be from about 4.5 to 8 inches, or about 5 to 7.5 inches, or about 5.5 inches.

In an exemplary embodiment, the outlet 30 can have an area that is substantially greater than the area of the inlet 20 of the nozzle assembly 10. For example, the ratio of the area of the outlet 30 to the area of the inlet 20 can be at least about 2.5:1, or about 2.5:1 to about 5:1, or about 3:1 to about 4.5:1, or about 3.5:1 to about 4:1.

By passing the flow of insulation particles through the nozzle assembly 10, the density of the insulation formed on the substrate can be controlled to achieve a thermal resistivity of, for example, from about R-3.3 to R-4.0 per inch, or about R-3.3 to R-4.2 per inch, or about R-3.7 per inch of insulation product. For example, for a standard 2×4 cavity, the thermal resistivity can be about R-13. Applicants have observed that when using an insulation material comprising fiberglass particles in conjunction with the methods, nozzle assemblies and systems described herein, an average blown-in insulation density of about 1.0 PCF can be sufficient to achieve a thermal resistivity of R-13.As such, by employing the nozzle assembly 10 having the structural characteristics described above, the desired insulation specification can be achieved while maintaining the average density at a desirable level such, thereby minimizing unnecessary costs associated with the use of excess materials.

In an exemplary embodiment, the outlet 30 can provide an insulation flow that has an adequate level of lateral particle dispersion, for example, such that the flow has a substantially uniform density wherein the density of the insulation particles is not substantially higher at the center of the flow dispersion pattern in comparison with the lateral edges of the flow dispersion pattern. For example, at least one obstruction (not shown) can be arranged at the center of the flow path of the nozzle assembly 10 that is capable of diverting some of the flow of insulation particles to either side of the obstruction, thereby increasing the uniformity of the density of the flow at the outlet 30. The at least one obstruction can be, for example, a protrusion disposed on the inner surface of the nozzle assembly 10, and can be arranged at any effective position in the nozzle assembly 10 upstream from the outlet 30. In an exemplary embodiment, two protrusions (not shown) can be arranged on opposite sides of the interior surface of the nozzle assembly 10, and substantially at the center of the flow path. The optional protrusions discussed above can also contribute to providing a more uniform flow of particles. In an embodiment where the outlet 30 has at least two axes of symmetry and the intersection of such axes of symmetry substantially correspond to the center of the inlet 20, the protrusions are not necessary.

The nozzle assembly 10 can include at least one binder outlet 50 for providing a binder flow to the particles of insulation material propelled from the outlet 30. For example, the at least one binder outlet 50 can provide a flow of liquid binder such as in the form of a jet or spray to the flow of insulation particles that is emitted from the outlet 30. In an exemplary embodiment, the nozzle assembly 10 includes two binder outlets 50 (the other binder outlet not shown) for spraying the binder on the particles of insulation material, a first binder spray outlet 50 being arranged at one side of the outlet 30 of the nozzle assembly 10 and a second binder outlet being arranged at the opposite side of the outlet 30. An exemplary spray jet that can be used is a 65 degree flat spray nozzle available from Spray-Tec Inc. located in Shelbyville, Ky.

The at least one binder outlet 50 can, for example, be adjustably mounted to the exterior of the nozzle assembly 10 by an adjustable mount 60 such that the position of the at least one binder outlet 50 can be adjusted by the user. The at least one binder outlet 50 can be connected to receive a flow of the binder from a binder conduit in communication with a binder source, via a binder inlet 54.

According to another aspect, a method of conveying particles of insulation material suspended in a flow of air to a wall, floor or ceiling cavity, can be employed. A flow of particles of insulation material suspended in air is provided to, for example, the nozzle assembly 10 described above. The flow can be provided via a conduit such as, for example, a flexible blow hose. The conduit can be any suitable length that enables convenient on-site use of the system, and the conduit can, for example, have a diameter that allows for good flow characteristics of the insulation particles through the conduit. For example, the diameter of the conduit can be from about 2 inches to about 4 inches, for example, about 3 inches. An end of the conduit can be attached to the inlet 20 of the nozzle assembly 10.

Any blowing machine suitable for blowing insulation particles can be used to generate the flow of insulation particles suspended in air. For example, the insulation particles can be fed to a conventional insulation blowing machine that entrains such particles in a rapidly moving air stream that exits the blowing machine via a flexible blowing hose. A typical blowing machine is a Unisul Volu-Matic machine available from Unisul Company located in Winter Haven, Fla.

The nozzle assembly 10 can be positioned to provide the flow of insulation particles suspended in air to the substrate on which the insulation material is to be formed, for example, a wall, floor or ceiling cavity. The nozzle assembly 10 can be positioned by hand and can include at least one handle 70, 72 to assist the positioning of the assembly 10. The nozzle assembly 10 can be positioned such that at the point of contact between the flow and the wall, floor or ceiling cavity, the flow has a flow dispersion pattern that is at least as wide as the distance between adjacent elongated supporting members in the wall, floor or ceiling cavity. The flow dispersion pattern at the point of contact with the substrate can generally depend on the settings of the blowing machine, the type and shape of insulation particles employed, the shape of the nozzle assembly, and the distance of the nozzle assembly to the substrate. In an exemplary embodiment, these factors can be adjusted to attain a flow dispersion pattern that is at least as wide as the distance between adjacent studs in the wall, floor or ceiling cavity, at the point of contact between the flow and the wall, floor or ceiling cavity. This can provide advantages such as reducing build-up of the insulation material on the elongated supporting members and/or fly off of the insulation material from the elongated supporting members, thereby facilitating the installation process.

The wall, floor or ceiling cavity can constitute the space between adjacent elongated supporting members such as, for example, studs or purlins. The distance between such elongated supporting members can depend on the specific application, for example, whether the substrate to be insulation is in a residential or commercial building. For example, the distance between elongated supporting members can be from about 12 inches on center and about 30 inches on center. In exemplary embodiments, standard distances between elongated supporting members that can be used are 16 inches on center and/or 24 inches on center.

During the installation process, the direction of the flow in insulation particles suspended in air propelled from the outlet 30 can be controlled by adjusting the position of the nozzle assembly 10. In an exemplary embodiment, the direction of the flow can be adjusted in a direction substantially parallel to the elongated supporting members, in order to fill the cavity with the insulation material. For example, the cavity can be filled with one or multiple passes of the flow of insulation particles in a direction that is substantially parallel to the elongated supporting members. In an exemplary embodiment, the nozzle assembly 10 is effective to emit a flow dispersion pattern that spans at least the width of the distance between adjacent elongated supporting members. Thus, for example, during the filling of a cavity, the direction of the flow need not be adjusted substantially in a direction perpendicular to the elongated supporting members and in one embodiment is only adjusted substantially in the parallel direction. The outlet 30 of the nozzle assembly 10 can be positioned at a distance from the substrate that allows for the efficient filling of the cavity, for example, from about 18 inches to about 30 inches, or about 22 inches to about 28 inches, or about 24 inches.

The insulation material used to form the insulation particles can be formed from any suitable insulation material, for example, the insulation can include inorganic fibers. The inorganic fibers can include fiberglass, slag wool, mineral wool, rock wool, ceramic fibers and carbon fibers. Additionally or alternatively, organic fibers such as cellulose fibers can be included in an exemplary embodiment. The average fiber diameter of the fibers can be, for example, about 6 microns or less, or about 3 microns or less, or about 2 microns or less. The insulation particles can be any suitable size, for example, such particles can have an average diameter of about 0.5 inch or smaller, for example, about 0.25 inches. The particles can be mostly smaller than one-half inch in diameter, but larger sizes can be used. The insulation material can optionally contain a substantially dry binder material prior to being blown, for example, a thermoset resin, that is activatable upon contact with the binder. Thus, the liquid binder ejected from the at least one binder outlet 50 of the nozzle assembly 10 can be water which activates the dry binder material present in the insulation material. The insulation material can contain additives such as infrared barrier agents, anti-static agents, anti-fungal agents, biocides, de-dusting agents, pigments, colorants, etc., or one or more of these functional ingredients can be applied to the fibers either before or during processing in the hammer mill or other reducing device.

The liquid binder that can be used with the nozzle assembly 10 can include any material that is effective to bind the insulation particles together to form the insulation product. For example, the liquid binder can contain a binder material and/or the liquid binder can function as an activator for a dry binder material present in the flow of insulation particles. In an exemplary embodiment, depending on the particular insulation particles and additives employed therewith, the liquid binder can constitute water.

For example, the liquid binder can be made up by adding the proper amount of water to a tank and then adding the proper amount of a resin, for example, a concentrated solution of the resin, to the water in the tank while optionally stirring to insure proper mixing. If a powdered resin is used, more time and stirring can be required to obtain the solution. Also, particularly when the water in the tank is cool, it may be advantageous to heat the water to at least room temperature before adding the resin. Numerous water-soluble resins can be used in the present invention. An exemplary resin for use in the present invention is a water soluble partially hydrolyzed polyester oligomer such as S-14063 and SA-3915 available from Sovereign Specialty Chemicals of Greenville, S.C. This resin can be diluted to a lower concentration when added to the water in a mixing and using tank, for example, to a concentration of less than 15 percent and most typically to about 11.5 percent. An adjustable rate pump connected to the use tank can supply the aqueous adhesive at the desired rate and pressure to the binder outlet through one or more flexible hoses to properly coat the insulation particles with the desired amount of liquid binder.

The insulation particles can be produced by running mineral fiber insulation such as virgin glass fiber insulation or fiber glass insulation containing a cured binder through a hammer mill, slicer-dicer or other device for reducing material to small particles. For example, a slicer-dicer cuts or shears blankets of fibrous insulation into small cube-like or other three dimensional pieces while hammer mills tear and shear virgin fiber glass or fiber glass blanket into pieces, letting only pieces below a pre-selected size out of the mill by using an exit screen containing predetermined opening sizes. The size of the openings can be adjusted to produce the desired size of insulation particles, and can be from about one inch to about three inches, for example, about 1.25 inches.

While the invention has been described in detail with reference to specific embodiments thereof, it will be apparent to one skilled in the art that various changes and modifications can be made, and equivalents employed without departing from the scope of the claims.

What is claimed is:

1. A nozzle assembly for conveying a flow of particles of insulation material suspended in air to a substrate to form an insulation product on the substrate, comprising:

a nozzle body defining a flow path for accommodating the flow of particles of insulation material suspended in air, wherein the nozzle body comprises an inlet for receiving the flow of particles of insulation material suspended in air and the inlet is substantially circle-shaped; an outlet for propelling the flow from the nozzle assembly and the outlet is substantially rectangular or square-shaped; at least one expansion section in which the cross-sectional area of the nozzle body expands in the direction of flow, the at least one expansion section being effective to reduce the velocity of the particles flowing therethrough; and with the nozzle body further comprising a section having a polygon-shaped cross-sectional profile having more than 4 sides, and at least one binder outlet mounted to the nozzle body for providing a binder to the flow of particles of insulation material propelled from the outlet.

2. The nozzle assembly according to claim 1, wherein the outlet of the nozzle body has a profile that is substantially square shaped.

3. The nozzle assembly according to claim 2, wherein the profile of the outlet has a width and a height of from about 5 to 6 inches.

4. The nozzle assembly according to claim 1, wherein the nozzle body comprises first and second expansion sections, wherein the second expansion section is contiguous with the outlet of the nozzle assembly.

5. The nozzle assembly according to claim 1, wherein the nozzle body is effective to reduce the velocity of the particles of insulation material propelled from the outlet by at least about 50%, based on the velocity of the particles introduced at the inlet.

6. The nozzle assembly according to claim 5, wherein the nozzle body is effective to reduce the velocity of the particles of insulation material propelled from the outlet by from about 70% to about 80%, based on the velocity of the particles introduced at the inlet.

7. The nozzle assembly according to claim 1, wherein the nozzle assembly comprises two binder outlets for providing the binder to the particles of insulation material, wherein a first binder outlet is arranged at one side of the outlet of the nozzle body and a second binder outlet is arranged at the opposite side of the outlet of the nozzle body.

8. The nozzle assembly according to claim 7, wherein the first binder outlet is mounted to an exterior of one side of the outlet of the nozzle body and the second binder outlet is mounted to an exterior of the opposite side of the outlet of the nozzle body.

9. A delivery system for forming an insulation product on a substrate, comprising:

the nozzle assembly according to claim 1;

a source of particles of insulation material, and a conduit for conveying insulation particles from the source of the particles of insulation material to the inlet of the nozzle assembly;

a source of a liquid binder, and a conduit for conveying the liquid binder from the source of the liquid binder to the at least one binder outlet of the nozzle assembly.

10. The delivery system according to claim 9, wherein the nozzle body is effective to reduce the velocity of the particles of insulation material propelled from the outlet by at least about 50%, based on the velocity of the particles introduced at the inlet.

11. The delivery system according to claim 10, wherein the nozzle body is effective to reduce the velocity of the particles of insulation material propelled from the outlet by from about 70% to about 80%, based on the velocity of the particles introduced at the inlet.

12. The nozzle assembly according to claim 1, wherein the at least one binder outlet is mounted to an exterior of the nozzle body.

13. A method of forming an insulation product on a substrate, comprising directing a flow of insulation particles suspended in air propelled from the nozzle assembly of claim 1 to the substrate.

14. The method according to claim 13, wherein the substrate is a wall, floor or ceiling cavity defined between adjacent elongated supporting members.

15. The method according to claim 14, further comprising a step of filling the wall, floor or ceiling cavity with the insulation material by adjusting the direction of the flow of insulation particles suspended in air, in a direction substantially parallel to the adjacent elongated supporting members which define the wall, floor or ceiling cavity.

16. The method according to claim 15, wherein the wall, floor or ceiling cavity is filled without substantially adjusting the direction of the flow of insulation particles suspended in air, in a direction perpendicular to the adjacent elongated supporting members.

17. The method according to claim 13, wherein the binder is provided to the particles of insulation material as they are emitted from the nozzle assembly and before the insulation product is formed on the substrate.

18. A method. of forming a blown-in insulation product, comprising directing a flow of particles of insulation material suspended in air emitted from the nozzle assembly of claim 1 at a substrate, wherein the flow emitted therefrom forms an insulation product on the substrate having a thermal resistivity of from about R-3.3 to R-4.0 per inch, wherein the flow emitted from the nozzle assembly is effective to minimize the density of the blown-in insulation product while maintaining the thermal resistivity of from about R-3.3 to R-4.0 per inch.

19. The method according to claim 18, wherein the blown-in insulation product has a thermal resistivity of about R-3.7 per inch.

20. The method according to claim 18, wherein the insulation product has an average density of about 1.0 PCF.

21. A blown-in insulation product formed from the method of claim 18, wherein the blown-in insulation product comprises fiberglass particles and has a thermal resistivity of about R-3.7 per inch.

* * * * *